US009751730B2

(12) United States Patent
Paβmann et al.

(10) Patent No.: US 9,751,730 B2
(45) Date of Patent: Sep. 5, 2017

(54) CRANE, IN PARTICULARLY OVERHEAD CRANE OR GANTRY CRANE, COMPRISING AT LEAST TWO CRANE GIRDERS

(71) Applicant: Terex MHPS GmbH, Düsseldorf (DE)

(72) Inventors: Christoph Paβmann, Dortmund (DE); Richard Kreisner, Ennepetal (DE); Thomas Schlierbach-Knobloch, Herdecke (DE)

(73) Assignee: Terex MHPS GmbH, Düsseldorf (DE)

( * ) Notice: Subject to any disclaimer, the term of this patent is extended or adjusted under 35 U.S.C. 154(b) by 0 days.

(21) Appl. No.: 14/433,076

(22) PCT Filed: Oct. 4, 2013

(86) PCT No.: PCT/EP2013/070752
§ 371 (c)(1),
(2) Date: Apr. 2, 2015

(87) PCT Pub. No.: WO2014/056809
PCT Pub. Date: Apr. 17, 2014

(65) Prior Publication Data

US 2015/0266703 A1 Sep. 24, 2015

(30) Foreign Application Priority Data

Oct. 9, 2012 (DE) ..... 10 2012 109 586

(51) Int. Cl.
*B66C 6/00* (2006.01)
*B66C 19/00* (2006.01)

(52) U.S. Cl.
CPC ..... *B66C 6/00* (2013.01); *B66C 19/00* (2013.01)

(58) Field of Classification Search
CPC .... B66C 5/00; B66C 5/02; B66C 5/04; B66C 5/06; B66C 6/00; B66C 7/00; B66C 7/08;
(Continued)

(56) References Cited

U.S. PATENT DOCUMENTS 327,360 A 9/1885 Vanes
3,294,252 A * 12/1966 Hosoi ..... B66C 6/00 212/312

(Continued)

FOREIGN PATENT DOCUMENTS

CN 202465064 10/2012
DE 260030 5/1913

(Continued)

OTHER PUBLICATIONS

International Search Report and Written Opinion for corresponding PCT Application No. PCT/EP2013/070752 dated Dec. 4, 2013.

(Continued)

*Primary Examiner* — Sang Kim
*Assistant Examiner* — Juan Campos, Jr.
(74) *Attorney, Agent, or Firm* — Gardner, Linn, Burkhart & Flory, LLP

(57) ABSTRACT

The invention relates to a crane, in particular an overhead crane or gantry crane, having at least two crane girders that extend horizontally in a longitudinal direction. The crane is designed as trussed girders and each girder includes an upper run with a moveable crane trolley and lifting gear. Each crane girders is composed of two upper run profiles that are connected together via a running rail for the crane trolley. By way of such a design, particularly simple assembly of the crane girders or of the crane can be achieved. Therefore, commercially available, conventional structural steel can be used for the upper run, from which the upper run is produced in a simple manner in terms of manufacturing technology by simple connection to a corresponding running rail.

20 Claims, 2 Drawing Sheets

(58) Field of Classification Search
CPC ..... B66C 11/00; B66C 11/14; B66C 17/00–17/26; B66C 19/00; B66C 19/002; B66C 19/005; B66C 19/007; B66C 19/02; B61B 13/04; B61B 5/02; E01B 25/08; E01B 25/10; Y10T 29/49634
USPC ..... 104/118–121
See application file for complete search history.

(56) References Cited

U.S. PATENT DOCUMENTS

| | | | | |
|---|---|---|---|---|
| 4,282,978 | A * | 8/1981 | Zambon | B66C 19/00 14/77.1 |
| 7,503,460 | B1 | 3/2009 | Petricio Yaksic | |
| 2011/0247993 | A1* | 10/2011 | Chernyak | B66C 6/00 212/324 |
| 2014/0291269 | A1* | 10/2014 | Passmann | B66C 17/00 212/312 |
| 2015/0053636 | A1* | 2/2015 | Pa mann | B66C 19/00 212/71 |
| 2015/0259179 | A1* | 9/2015 | Pa mann | B66C 19/00 212/71 |

FOREIGN PATENT DOCUMENTS

| | | | | |
|---|---|---|---|---|
| DE | 1095486 | | 12/1960 | |
| DE | 1218679 | | 6/1966 | |
| DE | 1971794 | | 11/1967 | |
| DE | 1907455 | | 10/1969 | |
| DE | 6604483 | | 1/1970 | |
| DE | 2239573 | | 9/1973 | |
| DE | 2419678 | | 11/1975 | |
| DE | 3222307 | | 12/1983 | |
| DE | 3731245 | | 3/1989 | |
| DE | 102012102808 | | 3/2012 | |
| DE | WO 2013144319 | A1 * | 10/2013 | B66C 17/00 |
| EP | 0928769 | | 7/1999 | |
| FR | 1391167 | | 1/1965 | |
| FR | 2478606 | | 9/1981 | |
| NL | 278615 | | 7/1964 | |

OTHER PUBLICATIONS

Co-pending and commonly-owned U.S. Appl. No. 14/432,682, filed Mar. 31, 2015.
English Translation of International Preliminary Report on Patentability for corresponding PCT Application No. PCT/EP2013/070752.

* cited by examiner

CRANE, IN PARTICULARLY OVERHEAD CRANE OR GANTRY CRANE, COMPRISING AT LEAST TWO CRANE GIRDERS

CROSS-REFERENCE TO RELATED APPLICATIONS

This application claims the benefit of International Application No. PCT/EP2013/070752, filed on Oct. 4, 2013, and also of German Application No. 10 2012 109 586.8, filed on Oct. 9, 2012, both of which are incorporated herein by reference in their entireties.

FIELD OF THE INVENTION

The present invention relates to a crane, in particular an overhead crane or gantry crane.

BACKGROUND OF THE INVENTION

German patent specification DE 260030 discloses a so-called double-girder gantry crane having two horizontal crane girders and two vertical support girders which form a gantry frame of the gantry crane. The crane girders extend in parallel and at a spaced interval with respect to each other. Arranged at each of the lower ends of the support girders is a travelling mechanism, by means of which the gantry crane can be moved in a direction of travel extending transversely with respect to the longitudinal direction of the crane girders. A crane trolley having a cable winch can be moved on and along the crane girders. According to the design as a double-girder crane, a load picking-up means of the cable winch arranged on the crane trolley is lowered or raised between the two crane girders. The crane girders are designed as trussed girders and comprise in each case an upper run and a lower run, which are each oriented horizontally and in parallel with each other, and vertically extending, rod-shaped posts and diagonally extending, rod-shaped struts which connect the upper and lower runs.

German utility model document DE 1 971 794 U describes a further double-girder overhead crane whose horizontal crane girders are designed in a similar manner as trussed girders and comprise in each case plate-shaped upper runs, rod-shaped lower runs and rod-shaped posts. A rail for a crane trolley is attached to each of the upper runs in the region of their inner edges.

German patent specification DE 37 31 245 C2 discloses a crane girder, designed as a box girder, for a double-girder overhead crane. The box girder includes an upper run and a lower run which are connected together via two side walls. The upper run is formed by a rolled profile designed as a T-profile girder having a horizontal flange and a vertical web which protrudes inwardly into the box girder and forms a reinforcing rib for the flange. Centrally and above the web, a rail which extends in the longitudinal direction, has a rectangular cross-section and consists of a solid material is welded onto the flange of the T-profile girder.

German utility model document DE 66 04 483 U discloses a double-girder overhead crane having two crane girders designed as box girders. The box girders are each composed of two I-girders. For this purpose, upper and lower flanges of the I-girders are connected together in that a multiplicity of run plates are arranged at a spaced disposition with respect to each other, are distributed over the entire length of the girders and are welded to the upper or lower flanges. Instead of a multiplicity of run plates, a single-piece, continuous upper run plate can be used for the upper flanges.

German laid-open document DE 22 39 573 A discloses a trussed girder. An upper run of the trussed girder is composed of two U-profiles, in that the mutually facing webs thereof are screwed together. In this respect, posts and struts of the trussed girder are arranged with their upper ends between the two webs of the U-profiles and are fixedly clamped via the screw connection.

SUMMARY OF THE INVENTION

The present invention provides a crane, in particular an overhead crane or gantry crane, having improved crane girders. The crane has at least two crane girders which extend horizontally in a longitudinal direction, are designed as trussed girders and each comprise an upper run and on which a crane trolley having a lifting gear can be moved.

According to one aspect of the invention, a crane, in particular an overhead crane or gantry crane, having at least two crane girders that extend horizontally in a longitudinal direction, are designed as trussed girders and each comprise an upper run on which a crane trolley having a lifting gear can be moved, the crane girders are advantageously improved by virtue of the fact that the upper runs are each composed of two upper run profiles which are connected together via a running rail for the crane trolley. By way of such a design, particularly simple assembly of the crane girders or of the crane can be achieved. Therefore, commercially available, conventional structural steel can be used for the upper run, from which the upper run is produced in a simple manner in terms of manufacturing technology by simple connection to a corresponding running rail.

In a structurally simple design, it is provided that the upper run profiles each include a horizontal flange and in each case the running rail is attached to upper sides of two adjacent flanges in order to connect the upper run profiles of one of the upper runs.

In an advantageous manner, it is further provided that the running rail is oriented centrally with respect to the upper run profiles, as seen in the longitudinal direction of the crane girder.

Furthermore, the fact that the running rail is produced from a solid material has an advantageous effect on the load-bearing capacity of the crane and the crane trolley running on the running rails.

In a structurally simple design, it is provided that the running rail has a rectangular cross-section. Therefore, commercially available steel rods can also be used for the running rails and the production of the crane can be simplified.

In an advantageous manner, the assembly is also simplified by virtue of the fact that the running rail is welded to the upper run profiles.

Furthermore, in an advantageous manner, it can be provided that the upper run profiles are formed as angular profile girders and each include a vertical web adjoining the flange.

Therefore, in a particularly simple manner, conventional L-profile girders can be used to produce the upper runs.

An additional advantage resides in the fact that the vertical webs extend in parallel with each other, are spaced apart from each other via a gap and the gap is bridged by the running rail.

In a structurally simple design, it is provided that the crane girders designed as trussed girders comprise struts and posts that each have upper apertures, into which the vertical webs protrude.

These and other objects, advantages and features of the invention will become apparent upon review of the following specification in conjunction with the drawings.

DESCRIPTION OF THE PREFERRED EMBODIMENTS

Figure 1:
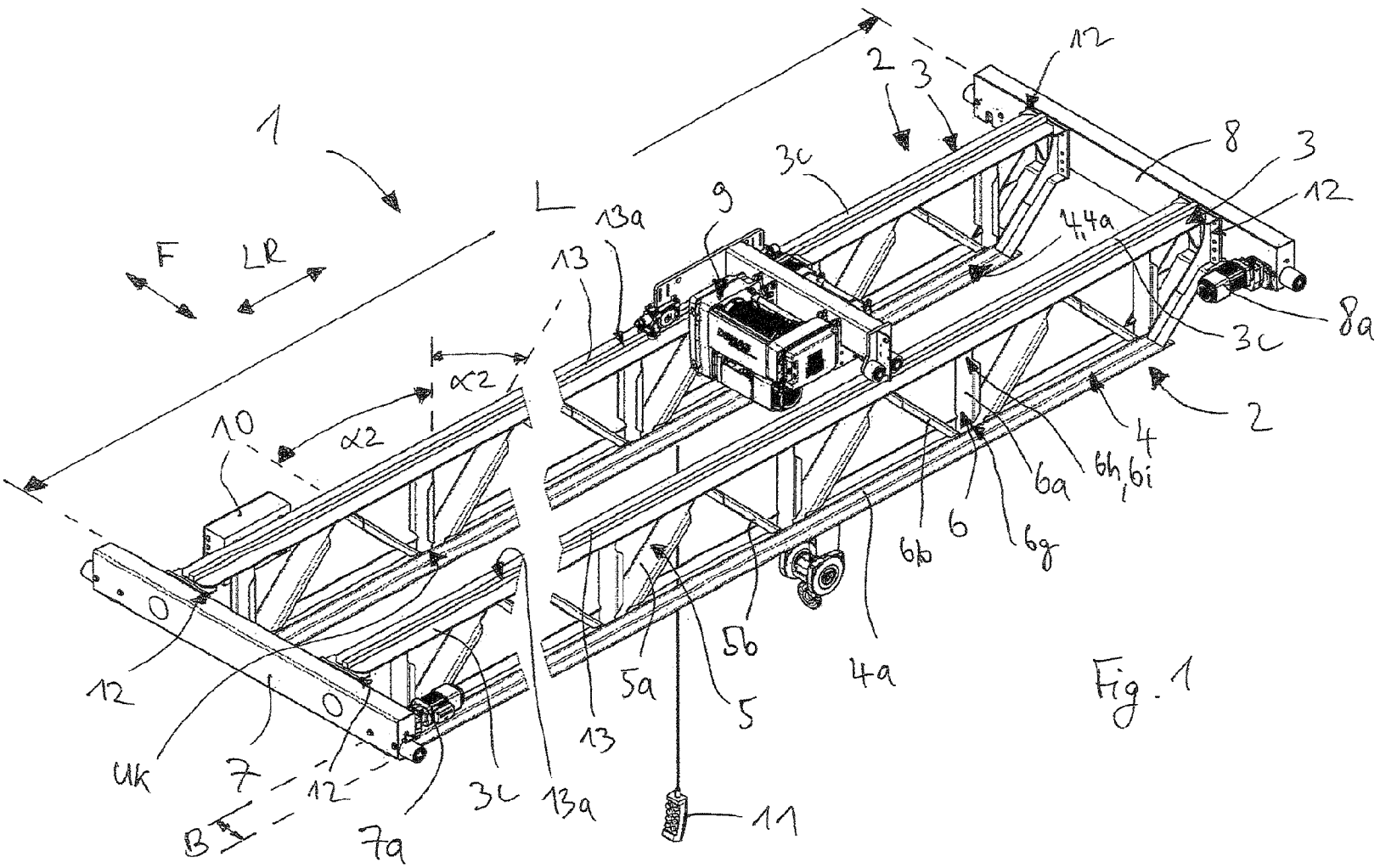
FIG. 1 is a perspective view of an overhead crane designed as a double-girder crane, having two crane girders in accordance with the invention.

Referring now to the drawings and the illustrative embodiments depicted therein, a crane 1 is designed as a double-girder overhead crane. It will be appreciated that the explanations given hereinafter with reference to an overhead crane also apply mutatis mutandis, to a gantry crane. The crane 1 includes two crane girders 2 designed as trussed girders that each extend in their longitudinal direction LR with the same length L and are oriented horizontally, in parallel and spaced apart from each other. First and second travelling mechanisms 7, 8 are attached to the opposite ends of the two crane girders 2 so that a frame is formed in plan view. The crane 1 can be moved in a horizontal direction of travel F transverse to the longitudinal direction LR of the crane girders 2 on rails, not illustrated, via the travelling mechanisms 7, 8. The rails are typically arranged at a height above the ground and for this purpose can be elevated, for example, via a suitable bearing structure or attached to opposite building walls. In order to move the crane 1 or the crane girders 2 thereof, the first travelling mechanism 7 is driven by a first electric motor 7*a* and the second travelling mechanism 8 is driven by a second electric motor 8*a*. A crane trolley 9 having a lifting gear designed as a cable winch is placed onto the two crane girders 2 and can be moved transverse to the direction of travel F of the crane 1 and along the longitudinal direction LR of the crane girders 2 via further travelling mechanisms. The crane trolley 9 runs on the upper runs 3 of the two crane girders 2. For this purpose, a running rail 13 having a corresponding running surface 13*a* is provided, preferably centrally, on each of the two upper runs 3 so that the crane trolley 9 is arranged between the crane girders 2. Accordingly, the crane trolley 9 arranged centrally between crane girders 2 can be moved between the two crane girders 2 and between the travelling mechanisms 7, 8. A load picking-up means of the cable winch arranged on the crane trolley 9 can be lowered or raised between the two crane girders 2. The crane 1 additionally includes a crane controller 10 and an overhead control switch 11 connected thereto, whereby the crane 1 or the electric motors 7*a*, 8*a* and the crane trolley 9 having the cable winch can be actuated and operated separately from each other.

The trussed structures of the two crane girders 2 are of identical design and each substantially include upper run 3, lower run 4, diagonally extending struts 5, and vertical posts 6. The struts 5 are generally considered to be those elements of a trussed structure that extend in an inclined manner or diagonally. The struts 5 of a trussed structure thereby differ from the elements that extend exclusively vertically and are designed as posts 6.

The upper run 3 and the lower run 4 each extend mostly in a straight line, spaced apart from one another and in parallel in the longitudinal direction LR between the travelling mechanisms 7, 8 except for at the opposite ends of the crane girders 2. The upper run 3 and the lower run 4 of each crane girder 2 are spaced apart from each other vertically.

Figure 2:
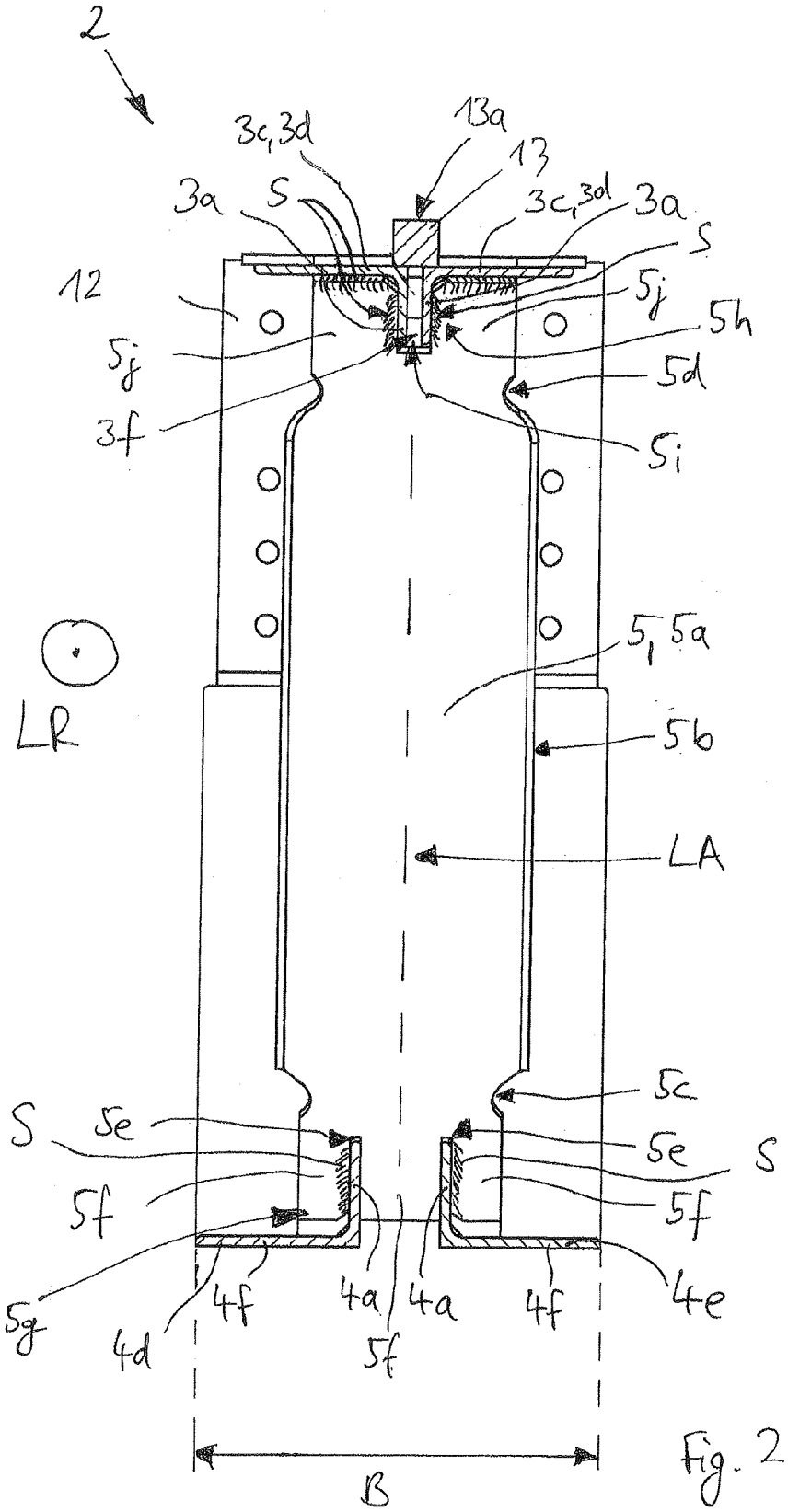
FIG. 2 is a cross-sectional view of one of the two crane girders of FIG. 1.

FIG. 2 illustrates a cross-sectional view of one of the two crane girders 2, with the aid of which the more precise structure of the crane girders 2 is explained.

Each upper run 3 is composed of two first and second upper run profiles 3*d*, 3*e*, which are arranged in a horizontal plane and are spaced apart from each other horizontally, and of the running rail 13 for the crane trolley 9, the running rail being welded to the upper run profiles 3*d*, 3*e*. In this case, the upper run profiles 3*d*, 3*e* and the running rail 13 extend in parallel in the longitudinal direction LR of the crane girder 2.

The two upper run profiles 3*d*, 3*e* are formed by an L-profile or angular profile girder, which in each case comprises a vertical web 3*a* and a horizontal flange 3*c* arranged at right angles thereto. The lower run 4 is likewise composed, analogously to the upper run 3, of two L-profile or angular profile girders, namely a first lower run profile 4*d* and a second lower run profile 4*e*. Each lower run profile 4*d*, 4*e* thus also includes a horizontal flange 4*f* and a vertical web 4*a* that are arranged at right angles to each other accordingly. The downwardly directed webs 3*a* of the upper run profiles 3*d*, 3*e* of the upper runs 3 and the upwardly directed webs 4*a* of the lower run profiles 4*d*, 4*e* of the lower runs 4 face each other. The distance of the outermost edges, as seen in the longitudinal direction LR, of the flanges 3*c*, 4*f* of the upper run profiles 3*d*, 3*e* or of the lower run profiles 4*d*, 4*e* moreover produces a width B of the corresponding crane girder 2.

FIG. 1 shows that the upper run 3 and the lower run 4 are connected together via several struts 5 and posts 6, which are each laminar. In this case, the laminar struts 5 or surface struts and posts 6 preferably absorb forces in the direction of their longitudinal axis and thus in the plane of extension of their planar major surface. Such surface elements or surface support structures are designated as discs in engineering mechanics whereas surface elements loaded perpendicularly to their plane of extension or major surface are designated as plates. Discs and thus also the surface struts differ e.g., from rods or rod-shaped posts and struts in that their thickness dimensions are substantially smaller than the length and width dimensions determining the planar extension of the disc. Accordingly, laminar struts 5 can also be designated as surface struts or disc struts.

In this case, the struts 5 are designed as a sheet metal profile having a major surface 5*a* having a substantially rectangular cross-section and are designed in particular to be mirror-symmetrical with respect to their longitudinal axis LA, wherein the long sides thereof are overturned in the form of minor surfaces 5*b* to increase the buckling strength at least in a central region. The basic structure of the laminar posts 6 corresponds—in the case of correspondingly adapted dimensions—substantially to the structure of the laminar struts 5. In this case, each of the laminar posts 6 extends with a major surface 6*a* transversely with respect to the longitudinal direction LR of the crane girder 2 and with minor surfaces 6*b*, which are folded at a right angle with respect thereto, in this longitudinal direction LR. The laminar posts 6 can also be arranged or oriented in such a manner that the minor surfaces 6*b* point towards or away from one of the ends of the crane girder 2.

The trussed structure of each crane girder 2 is terminated at the opposite ends of the upper run 3 and of the lower run 4 by an adapter 12 in each case. The upper run 3 and the lower run 4 are connected using the adapters 12 to form a frame.

Starting from one of the two adapters 12 as seen in the longitudinal direction LR of the crane girder 2, the first laminar post 6 forms, together with a first strut 5 connected to the lower run 4, a common lower node point UK on the lower run 4. The first strut 5 extends in the longitudinal direction LR obliquely at a setting angle α2 in the direction of the upper run 3 and is fastened at that location. In this case, the setting angle α2 is enclosed by the first strut 5 and the post 6 terminating in the lower node point UK. Preferably, the setting angle α2 is in a range of 35 degrees to 55 degrees and in particular is preferably 45 degrees. A second strut 5 adjoins the first strut 5 at the upper run 3 and extends obliquely at the setting angle α2 downwards to the next lower node point UK on the lower run 4. This is repeated until the struts 5 reach the opposite end of the crane girder 2. Therefore, each strut 5 together with a laminar post 6 forms in the region of the corresponding lower node point UK on the lower runs 4 a setting angle α2 of the same size. In this case, an even number of struts 5 arranged in the manner of a pitched roof obliquely or diagonally with respect to one another is always used, so that the last strut 5 terminates at, and descends towards, the lower run 4. Depending upon the length L of the crane girder 2, prior to assembly the setting angle α2 is determined, so that an even number of struts 5 is used such that each have the same length and are at the same setting angle α2. As a consequence, the upper run 3, which bears the running rail 13, is reinforced to protect it against bending.

The struts 5 are oriented within the trussed structure of each crane girder 2 such that in each case their major surface 5*a* extends transversely with respect to the longitudinal direction LR of the crane girder 2. Moreover, the struts 5 are welded to the lower run 4 with their lower first strut ends 5*g*.

An upper aperture 5*i*, 6*i* is provided in each case in the struts 5 and posts 6 at their upper second strut ends 5*h* or post ends 6*h*, the webs 3*a* of the upper run profiles 3*d*, 3*e* protruding into the apertures and in that position lying against long sides of the upper aperture 5*i*, 6*i* and being welded in this region to the struts 5 and posts 6 (see also FIG. 2). In this case, the horizontal flanges 3*c* of the upper run profiles 3*d*, 3*e* each point outwards and thus away from the upper apertures 5*i*, 6*i* of the struts 5 or posts 6. The laminar posts 6 are slid onto the webs 4*a* of the lower run profiles 4*d*, 4*e* with their lower first post end 6*g* or a lower aperture 6*e* arranged therein, and are welded thereto. It is also feasible to provide, in an identical manner to the struts 5, lower apertures 6*e* in the first post end 6*g*, one for each web 4*a*. As seen transversely with respect to the longitudinal direction LR of the crane girder 2, only one strut 5 and one post 6 is always provided between the webs 3*a* of the upper run 3.

Furthermore, FIG. 2 illustrates that two strut arms 5*j* are formed on the upper second strut end 5*h* in the region of the upper corners of the struts 5, in that upper aperture 5*i* having a substantially rectangular cross-section is provided in the major surface 5*a* centrally on the upper second strut end 5*h* and centred with respect to the longitudinal axis LA of the strut 5. The upper aperture 5*i* extends starting from the upper second strut end 5*h* in parallel with the longitudinal axis LA, wherein the opposite long sides of the upper aperture 5*i* extend at the same distance on the right-hand side and on the left-hand side of the longitudinal axis LA. The upper aperture 5*i* is dimensioned, as seen transversely with respect to the longitudinal axis LA, such that at least the two webs 3*a*, pointing vertically downwards, of the two upper run profiles 3*d*, 3*e* can be inserted or slid into the upper aperture 5*i*.

It can also be seen from FIG. 2 that the webs 3*a* of the two upper run profiles 3*d*, 3*e* lie with their outer sides facing the long sides of the upper aperture 5*i* against the long sides, and that at that location a weld connection is produced along the weld seams S. A further weld connection is provided between the upper run 3 and the upper second strut ends 5*h*, in particular in the form of horizontal weld seams S between the strut arms 5*j* and the flanges 3*c* of the upper run profiles 3*d*, 3*e* lying on their end faces pointing towards the longitudinal axis LA.

As an alternative to the illustration in FIG. 2, it is also feasible that not only one upper aperture 5*i* but rather two upper apertures 5*i* are provided, analogously to lower apertures 5*e*. The major surface 5*a* can then extend, just like between the lower apertures 5*e*, also between the upper apertures 5*i* towards the upper second strut end 5*h* and form in this case a central third strut arm 5*j*. In particular, the central strut arm 5*j* formed by the major surface 5*a* can drop behind the end faces of the strut feet 5*f* or the end faces of the two outer strut arms 5*j*, as seen in the direction of the longitudinal axis LA, provided that the apertures 5*e*, 5*i* have at least one slot-shaped cross-section, which is sufficiently deep to receive or position the webs 3*a*, 4*a* of the upper and lower runs 3, 4.

It can also be seen in FIG. 2 that the webs 3*a* of the upper run profiles 3*d*, 3*e* are preferably arranged to be closer to one another and thus at less of a distance away from the longitudinal axes LA of the struts 5 than the webs 4*a* of the lower run profiles 4*d*, 4*e*. As a result, the upper run profiles 3*d*, 3*e* of each upper run 3 of the two crane girders 2 can be connected together at upper sides remote from the webs 3*a* via the running rail 13, which is likewise illustrated in FIG. 2. Therefore, a corresponding running rail 13 is welded to the upper sides of the upper run profiles 3*d*, 3*e* in order to connect the upper run profiles 3*d*, 3*e* arranged horizontally next to each other.

The running rails 13 have a rectangular cross-section and each form at their upper sides one of the running surfaces 13*a* for the travelling mechanisms, not illustrated here, of the crane trolley 9. Each running rail 13 is preferably arranged centrally or centred with respect to the two parallel webs 3*a* of the corresponding upper run profiles 3*d*, 3*e* and thus also centred with respect to the longitudinal axis LA of the strut 5. Moreover, the running rail 13 is dimensioned such that it bridges the spaced disposition between the webs 3*a* inserted into the upper aperture 5*i* and can be welded to the flanges 3*c* of the upper run profiles 3*d*, 3*e* along the longitudinal direction LR of the crane girder 2.

Changes and modifications to the specifically described embodiments may be carried out without departing from the principles of the present invention, which is intended to be limited only by the scope of the appended claims as interpreted according to the principles of patent law including the doctrine of equivalents.

The invention claimed is:

1. A crane comprising: at least two crane girders that extend horizontally in a longitudinal direction, wherein the girders are designed as trussed girders and each includes an upper run configured to support a movable crane trolley having a lifting gear, wherein the upper runs are each composed of a first upper run portion and a second upper run portion, which two upper run portions are connected together by a running rail positioned atop and spanning a gap defined between the two upper run portions of each upper run.

2. The crane of claim 1, wherein the upper run portions each comprise a horizontal flange and in each case the running rail is attached to upper sides of two adjacent flanges in order to connect the upper run portions of one of the upper runs.

3. The crane of claim 2, wherein the upper run portions are formed as angular profile girders and each include a vertical web adjoining the respective flange.

4. The crane of claim 3, wherein the crane girders designed as trussed girders comprise struts and posts that each have upper apertures, into which the vertical webs protrude.

5. The crane of claim 2, wherein the running rail is arranged centrally between the upper run portions.

6. The crane of claim 2, wherein the upper run portions are formed as angular profile girders and each include a vertical web adjoining the flange.

7. The crane of claim 6, wherein the vertical webs extend in parallel with each other and are spaced apart from each other by the gap.

8. The crane of claim 2, wherein the running rail is welded to the upper run portions.

9. The crane of claim 1, wherein the running rail is arranged centrally between the upper run portions.

10. The crane of claim 9, wherein the upper run portions are formed as angular profile girders and each include a vertical web adjoining the flange.

11. The crane of claim 10, wherein the vertical webs extend in parallel with each other and are spaced apart from each other by the gap.

12. The crane of claim 9, wherein the running rail is welded to the upper run portions.

13. The crane of claim 1, wherein the running rail is produced from a solid material.

14. The crane of claim 1, wherein the running rail has a rectangular cross-section.

15. The crane of claim 1, wherein the running rail is welded to the upper run portions.

16. A crane comprising:

at least two crane girders that extend horizontally in a longitudinal direction, wherein the girders are designed as trussed girders and each includes an upper run configured to support a movable crane trolley having a lifting gear;

wherein the upper runs are each composed of a first upper run portion and a second upper run portion;

a running rail positioned atop and spanning between the two upper run portions of each upper run, wherein the two upper run portions are connected together by the running rail;

wherein the upper run portions are formed as angular profile girders and each include a vertical web adjoining a horizontal flange; and wherein the vertical webs extend in parallel with each other, are spaced apart from each other by a gap, and the gap is bridged by the running rail.

17. The crane of claim 16, wherein the crane girders designed as trussed girders comprise struts and posts that each have upper apertures, into which the vertical webs protrude.

18. The crane of claim 16, wherein the running rail is arranged centrally between the upper run portions, and wherein the crane girders designed as trussed girders comprise struts and posts that each have upper apertures, into which the vertical webs protrude.

19. The crane of claim 18, wherein the upper run portions each comprise a horizontal flange and in each case the running rail is attached to upper sides of two adjacent flanges in order to connect the upper run portions of one of the upper runs.

20. A crane comprising:

at least two crane girders that extend horizontally in a longitudinal direction, wherein the girders are designed as trussed girders and each includes an upper run configured to support a movable crane trolley having a lifting gear;

wherein the upper runs are each composed of a first upper run portion and a second upper run portion;

a running rail positioned atop and spanning between the two upper run portions of each upper run, wherein the two upper run portions are connected together by the running rail;

wherein the upper run portions are formed as angular profile girders and each include a vertical web adjoining a horizontal flange; and wherein the crane girders designed as trussed girders comprise struts and posts that each have upper apertures, into which the vertical webs protrude.

* * * * *